US011177559B2

(12) United States Patent
Wu et al.

(10) Patent No.: US 11,177,559 B2
(45) Date of Patent: Nov. 16, 2021

(54) RADIATOR ASSEMBLY FOR BASE STATION ANTENNA

(71) Applicant: CommScope Technologies LLC, Hickory, NC (US)

(72) Inventors: Bo Wu, Suzhou (CN); PuLiang Tang, Suzhou (CN); Ruixin Su, Suzhou (CN); YueMin Li, Suzhou (CN); Hangsheng Wen, Suzhou (CN); Ligang Wu, Suzhou (CN)

(73) Assignee: CommScope Technologies LLC, Hickory, NC (US)

( * ) Notice: Subject to any disclaimer, the term of this patent is extended or adjusted under 35 U.S.C. 154(b) by 18 days.

(21) Appl. No.: 16/860,249

(22) Filed: Apr. 28, 2020

(65) Prior Publication Data

US 2020/0358169 A1 Nov. 12, 2020

(30) Foreign Application Priority Data

May 8, 2019 (CN) ..... 201910377664.2

(51) Int. Cl.

| | |
|---|---|
| ***H01Q 21/26*** | (2006.01) |
| ***H01Q 1/24*** | (2006.01) |
| ***H01Q 21/06*** | (2006.01) |
| *H01Q 9/28* | (2006.01) |
| *H01Q 5/48* | (2015.01) |

(52) U.S. Cl.

CPC ..... *H01Q 1/246* (2013.01); *H01Q 21/062* (2013.01); *H01Q 21/26* (2013.01); *H01Q 1/24* (2013.01); *H01Q 5/48* (2015.01); *H01Q 9/28* (2013.01)

(58) Field of Classification Search

CPC ..... H01Q 1/246; H01Q 21/062; H01Q 21/26; H01Q 5/48; H01Q 9/28; H01Q 1/24

USPC ..... 343/797, 798, 795

See application file for complete search history.

(56) References Cited

U.S. PATENT DOCUMENTS

| | | | | |
|---|---|---|---|---|
| 11,018,437 | B2 * | 5/2021 | Tang | H01Q 5/42 |
| 2017/0264021 | A1 | 9/2017 | Wolfgang et al. | |
| 2017/0317420 | A1 | 11/2017 | Sadegh et al. | |
| 2018/0261929 | A1 | 9/2018 | Bruno et al. | |

FOREIGN PATENT DOCUMENTS

| | | | |
|---|---|---|---|
| CN | 203386887 | U | 1/2014 |
| WO | 2018/007348 | A1 | 1/2018 |

OTHER PUBLICATIONS

Notification of Transmittal of the International Search Report and the Written Opinion of the International Searching Authority, or the Declaration, corresponding to International Application No. PCT/US2020/026610, dated Jul. 21, 2020.

* cited by examiner

*Primary Examiner* — Joseph J Lauture
(74) *Attorney, Agent, or Firm* — Myers Bigel, P.A.

(57) ABSTRACT

A radiator assembly for a base station antenna has a central axis and two dipoles arranged in a crossed manner, where each of the dipoles includes two dipole arms, and each of the dipole arms have a radiating surface which has an outer contour. The radiator assembly comprises an electrically conductive annular element that mounted above the radiating surfaces. The annular element is configured to be closed circumferentially and has an inner contour which is compliant to an outer contour line of the combination of all four radiating surfaces.

19 Claims, 3 Drawing Sheets

RADIATOR ASSEMBLY FOR BASE STATION ANTENNA

CROSS-REFERENCE TO RELATED APPLICATION

The present application claims priority to Chinese Patent Application No. 201910377664.2, filed May 8, 2019, the entire content of which is incorporated herein by reference as if set forth fully herein.

FIELD

The present invention relates to the technical field of base station antennas, and more particularly to a radiator assembly for a base station antenna.

BACKGROUND

The mobile communication network includes a large number of base stations for receiving and transmitting communication signals. A single base station antenna may include many radiator assemblies, which may also be referred to as radiating elements or antenna elements. The cost of a single radiator assembly has a significant impact on the cost of the entire base station antenna. Miniaturization and cost minimization of radiator assemblies are desirable.

In 2G/3G/4G/LTE systems, there have been developed a large number of dual-polarized radiator assemblies designed to operate in a 2 GHz frequency band, which may cover, for example, a frequency range of 1.69 to 2.69 GHz. In addition, a 1.4/1.5 GHz frequency band is valuable in International Mobile Telecommunications (IMT) services. The 1.4/1.5 GHz band may cover, for example, a frequency range of 1427 to 1518 MHz. Currently, the of 1427 to 1518 MHz frequency band has been used in Japan for IMT services. Many European countries support a frequency range of 1452 to 1492 MHz, and some European countries also support a frequency range of 1427 to 1518 MHz. In addition, the United States supports a frequency range of 1695 to 1700 MHz for 5G communication. Therefore, in the design of base station antennas, it is desirable to broaden the operating frequency range of the radiator assemblies. It is especially desirable to broaden the operating frequency range of the radiator assemblies to cover not only a frequency band of 1.4/1.5 GHz but also a frequency band of 1.695-2.69 GHz.

SUMMARY

The object of the present invention is to provide a radiator assembly for a base station antenna, which is compact in structure and broad-band.

The object is achieved by a radiator assembly for a base station antenna, having a central axis and two dipoles arranged in a crossed manner, wherein each of the dipoles includes two dipole arms, and each of the dipole arms has a radiating surface having an outer contour, wherein the radiator assembly comprises an annular element that is electrically conductive, wherein the annular element is mounted above the radiating surfaces, the annular element is configured to be closed circumferentially and has an inner contour which is compliant to an outer contour line for the combination of all four radiating surfaces. The compliance is defined as: in a projection along the central axis on a projection plane perpendicular to the central axis, the inner contour of the annular element has a projected inner contour line which surrounds a first area and the outer contours of the radiating surfaces have respective projected outer contour lines, where every two adjacent projected outer contour lines are connected through imaginary connecting lines, where each imaginary connecting line is a chord of a respective imaginary circular arc line, wherein each circular arc line is concentric with the central axis and has a radius that is ½ of a maximum radius of the projected outer contour lines of the radiating surfaces, where the projected outer contour lines and the connecting lines together define a maximum outer contour line that is closed circumferentially and that surrounds a second area, wherein the first area and the second area overlap by at least 90%, in other words, an overlapping area of the first area and the second area is 90% or more of a larger area of the first area and the second area.

Here, the radiating surfaces may be designed at a high center frequency. The frequency band is spread to a low frequency end by the resonance of the annular element. Since it is defined in the sense of the present invention that "the annular element has an inner contour which is compliant to an outer contour line of the combination of all four radiating surfaces", the spreading of the frequency band to the low frequency end and a compact size are achieved advantageously. The radiator assembly with the annular element according to the present invention may have a reduced planar size compared to a radiator assembly without such an annular element.

In the sense of the present invention, when the orientation of a member of the radiator assembly is described, the terms "above" and "below" can be understood as a relative orientation. For example, the expression "the member A is mounted above the member B" means that the member A is mounted farther outward from the reflective plate then the member B, or to say, the member A is disposed at the side of the member B facing away from the reflective member or facing away from the bottom plate of the radiator assembly.

In some embodiments, the radiator assembly is configured to cover not only a frequency band of 1.4/1.5 GHz but also a frequency band of 2 GHz.

In some embodiments, the first area and the second area my overlap by at least 95%, for example by at least 98%. In other words, the overlapping area may be 95% or more of the larger area, and may be for example 98% or more of the larger area.

In some embodiments, the radiating surfaces may be formed on a common printed circuit board. In other embodiments, the dipole arms may be formed as respective separate members, such as metal members, and may be mounted in a holder.

In some embodiments, each radiating surface may have an outer contour that deviates from a rectangle.

In some embodiments, with reference to the central axis, from a radially interior to a radially exterior, the projected outer contour lines of the radiating surfaces may have a width that first increases gradually and then decreases gradually. For example, the radiating surfaces may be configured to be in the shape of a leaf, an ellipse or a spindle. Perforations may be provided in the radiating surfaces. The radiating surfaces may also be constructed to be full-area.

In some embodiments, the printed circuit board may be mounted above a reflective plate, and the radiator assembly may comprise a plurality of spacers through which the annular element is mounted above the printed circuit board at a predetermined distance.

In some embodiments, as viewed along the central axis, there may be gaps between every two adjacent radiating surfaces, where the annular element may have areas that project into the respective gaps.

In some embodiments, as viewed along the central axis, the annular element may have a greater width in the areas than in remaining areas.

In some embodiments, the annular element may be made of a sheet metal. In other embodiments, the annular element may comprise an electrically conductive layer on a printed circuit board.

In some embodiments, the radiator assembly may have a director which may be mounted above the annular element.

In some embodiments, the radiating surfaces may be formed on a common printed circuit board, wherein the director may be supported on the printed circuit board by means of a holder which may have a plurality of support points distributed around the central axis on the printed circuit board.

In some embodiments, the director may be constructed as a prismatic metal plate which may be oriented such that the corners of the metal plate are located in areas of gaps between adjacent radiating surfaces, as viewed along the central axis.

In some embodiments, a pair of the corners of the metal plate may be chamfered.

In some embodiments, in a projection along the central axis on the projection plane, an outer contour of the director has a projected outer contour line which surrounds a third area, where the third area may overlap with a projection of the annular element in the areas of the corners, and at least 90% of the third area may be within a projected inner contour line of the annular element.

It is to be noted here that, the aforementioned technical features and the technical features which will be mentioned later may be arbitrarily combined with each other as long as they are not contradictory to one another. All the technically feasible feature combinations pertain to technical contents specifically recited in the present application.

DETAILED DESCRIPTION

Figure 1:
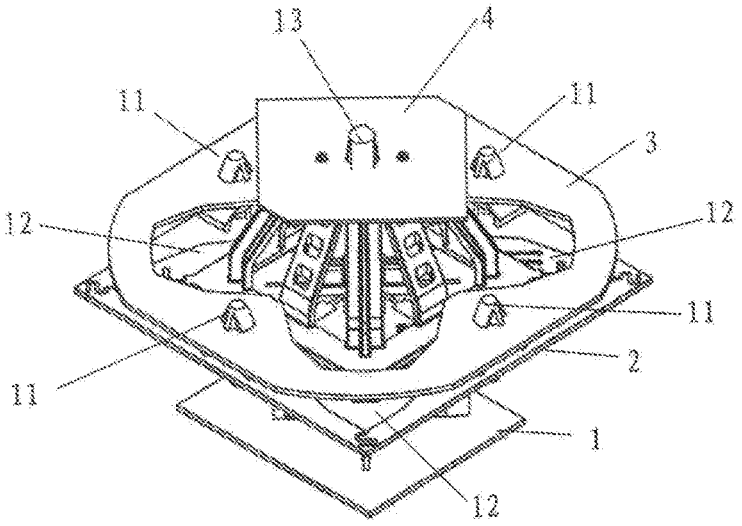
FIG. 1 is a perspective view of a radiator assembly for a base station antenna according to an embodiment of the present invention.
Figure 2:
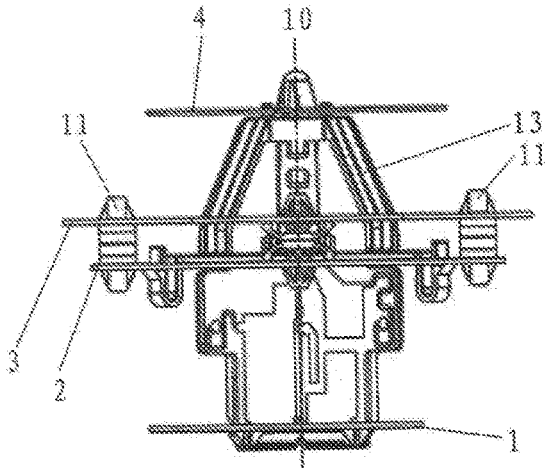
FIG. 2 is a side view of the radiator assembly according to FIG. 1.
Figure 3:
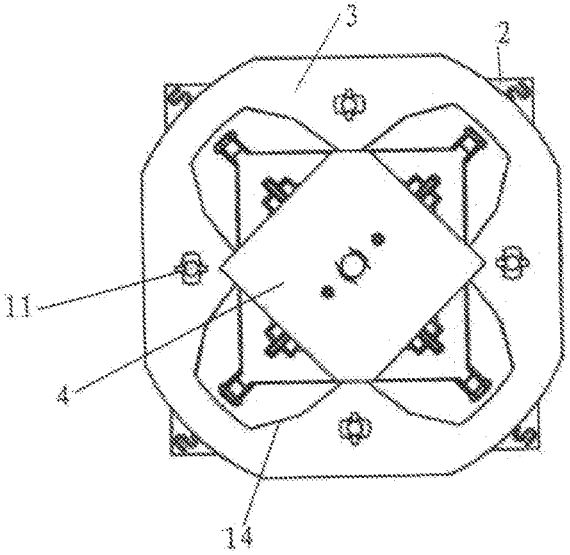
FIG. 3 is a top view of the radiator assembly according to FIG. 1.

FIG. 1 is a perspective view of a radiator assembly for a base station antenna according to an embodiment of the present invention, FIG. 2 is a side view of the radiator assembly according to FIG. 1, and FIG. 3 is a top view of the radiator assembly according to FIG. 1.

A small portion of a reflective plate 1 is illustrated in FIGS. 1-3. An array of radiator assemblies may be mounted on the reflective plate 1, one of which is shown in FIGS. 1-3. While the reflective plate 1 is disposed horizontally in FIGS. 1-3 with the radiator assembly extending upwardly therefrom, it will be appreciated that in actual use the reflective plate typically extends substantially in the vertical direction, and the radiator assemblies extend forwardly from the reflective plate 1. Thus, while the discussion below describes the radiator assembly in the orientation shown in FIGS. 1-3, it will be appreciated that the radiator assemblies and reflective plate 1 would typically be rotated approximately 90 degrees when a base station antenna that includes the radiator assemblies is mounted for use.

The illustrated radiator assembly comprises two dipoles arranged in a crossed manner, where each of the dipoles includes two dipole arms, and each of the dipole arms has a respective radiating surface 12 which may be fed with radio frequency (RF) signals. In some embodiments, the radiating surfaces 12 are formed on a common printed circuit board 2, although other implementations are possible including, for example, sheet metal radiating surfaces or die cast metal radiating surfaces. The radiating surfaces 12 may have respective outer contours that deviate from a rectangle, and surround a central axis 10 of the radiator assembly. There may be a gap between every two adjacent radiating surfaces 12. The gap is an electrical gap, so that a physical gap on the printed circuit board 2, such as a slot cut in the printed circuit board 2, may not be necessary. In the depicted embodiment, a pair of so-called "feed stalk" printed circuit boards are used to support the printed circuit board 2 forwardly of the reflective plate 1.

An annular element 3 may be mounted at a predetermined distance above the printed circuit board 2 by a plurality of distributed spacers 11. In some embodiments not shown, one or more additional (e.g., one, two, three, etc.) annular elements may also be mounted either above or below the printed circuit board 2. The annular element 3 is configured to be closed circumferentially and has an inner contour 14. The annular element 3 may be made of sheet metal. In other embodiments, the annular element 3 may comprise a printed circuit board that has an electrically conductive layer that is closed circumferentially. The annular element 3 may be a two-dimensional or three-dimensional member. The lower end of the operating frequency band of the radiator assembly may be broadened by the resonant effect of the annular element 3. At the same time, the planar dimension of the radiating element may be reduced correspondingly.

A director 4 may be mounted above the annular element 3. The director 4 may be supported on the printed circuit board 2 by means of a holder 13. The holder 13 has a plurality of support points distributed around the central axis 10 of the printed circuit board 2. The director 4 may be constructed as a metal plate having a prism shape. The metal plate may be oriented such that the corners of the prism are located in areas of the gaps between the adjacent radiating surfaces 12, as viewed along the central axis 10. A pair of the corners of the metal plate may be chamfered. In a projection along the central axis 10 on the projection plane, the outer contour of the director 4 has a projected outer contour line which surrounds a third area. The third area may overlap with a projection of the annular element 3 in the areas of the corners, and at least 90% of the third area may be within a projected inner contour line of the annular element 3. The director 4 may facilitate achieving a favorable impedance matching in the radiator assembly, and may also assist in controlling the direction of the RF radiation emitted by the radiator assembly and/or may help narrow a beam width of the emitted radiation.

As noted above, in FIGS. 1 to 3, the reflective plate 1 is described in a horizontal state, and the radiator assembly is above the reflective plate 1. In a mounted state of the base station antenna, the reflective plate 1 may have different orientations, for example, the reflective plate 1 may be oriented obliquely to the sky with respect to a horizontal plane, or may be oriented perpendicular to the horizontal plane, or may be oriented obliquely to the ground with respect to the horizontal plane. Here, although the absolute orientation of the radiator assembly changes, the relative orientation of the radiator assembly to the reflective plate 1 remains unchanged. Thus, herein the terms "above" and "below" can be understood as the relative orientation. For example, the expression "the annular element 3 is mounted above the printed circuit board 2" means that the annular element 3 is mounted farther outward from the reflective plate 1 than the printed circuit board 2 if the reflective plate is mounted to extend along a vertical axis.

Figure 4:
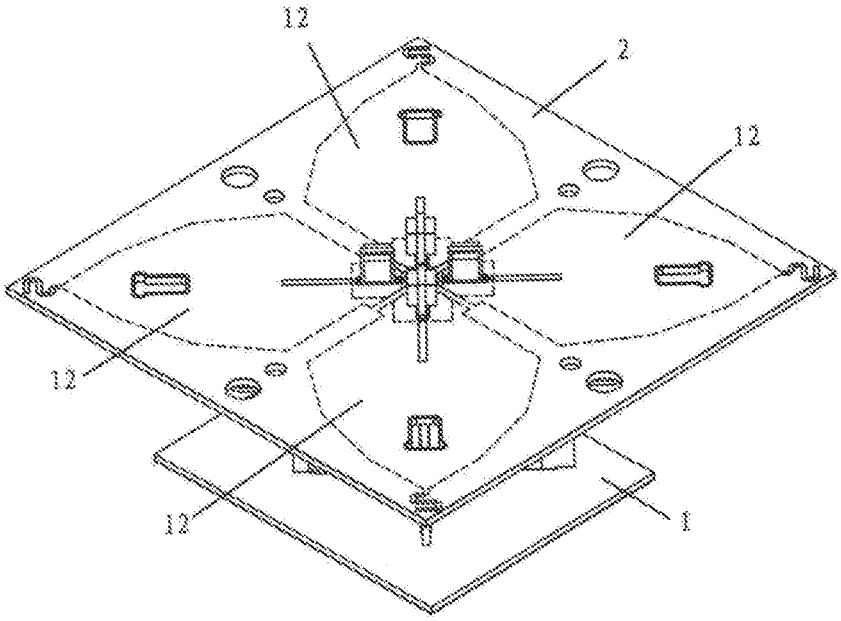
FIG. 4 is a perspective view of some components of the radiator assembly according to FIG. 1.

FIG. 4 is a perspective view of some components of the radiator assembly of FIG. 1, where the director 4, the holder 13 and the annular element 3 are omitted, so that the details of the print circuit board 2 can be illustrated more clearly. In FIG. 4, the outer contours of the radiating surfaces 12 are illustrated schematically with dotted lines.

Figure 5:
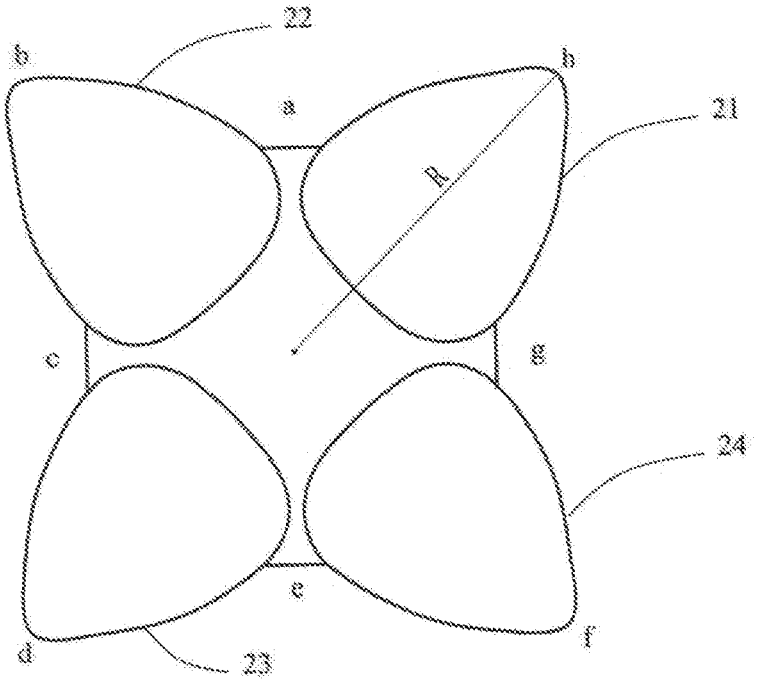
FIG. 5 is a simplified schematic view that illustrates a projection of the radiating surfaces of the radiator assembly of FIG. 1 along a central axis in a projection plane that is perpendicular to the central axis.

FIG. 5 is a schematic view that illustrates a projection of the radiating surfaces 12 along the central axis 10 in a projection plane that is perpendicular to the central axis 10. The radiating surfaces 12 have projected outer contour lines 21, 22, 23, 24 with gaps therebetween. In order to define an outer contour line for the combination of all four radiating surfaces 12, where the contour line is closed circumferentially, imaginary connecting lines a, c, e, g are specified in FIG. 5 as connecting lines between adjacent ones of the outer contour lines 21, 22, 23, 24. The connecting lines a, c, e, g are chords of imaginary circular arc lines which are concentric with the central axis 10 and have a radius that is ½ of a maximum radius R of the outer contour lines 21, 22, 23, 24. The outer contour lines 21, 22, 23, 24 and the connecting lines a, c, e, g together define a maximum outer contour line that is closed circumferentially and includes the connecting line a; the outer line segment b of the outer contour line 22 which is located between the connecting lines a, c; the connecting line c; the outer line segment d of the outer contour line 23 which is located between the connecting lines c, e; the connecting line e, the outer line segment f of the outer contour line 24 which is located between the connecting lines e, g; the connecting line g, the outer line segment h of the outer contour line 21 which is located between the connecting lines g, a.

The inner contour 14 of the annular element 3 may be "compliant" to the outer contour line for the combination of all four radiating surfaces 12. Herein the inner contour 14 of the annular element 3 is considered to be "compliant" to the outer contour line for the combination of all four radiating surfaces 12 if, in a projection along the central axis 10 on a projection plane that is perpendicular to the central axis, (1) the inner contour 14 of the annular element 3 has a projected inner contour line which surrounds a first area, (2) the outer contours of the radiating surfaces 12 have respective projected outer contour lines 21, 22, 23, 24 (see FIG. 5), where the outer contour lines 21, 22, 23, 24 of every two adjacent projections (namely, 21, 22; 22, 23; 23, 24; 24, 21) are connected through imaginary connecting lines a, c, e, g, where each imaginary connecting line a, c, e, g is a chord of a respective imaginary circular arc line, where each circular arc line is concentric with the central axis 10 and each circular arc line has a radius that is ½ of a maximum radius R of the projected outer contour lines 21, 22, 23, 24 of the radiating surfaces 12, where the projected outer contour lines 21, 22, 23, 24 and the connecting lines a, c, e, g together define a maximum outer contour line that is closed circumferentially and that surrounds a second area, and (3) the first area and the second area overlap by at least 90%.

In some embodiments, the first area and the second area may overlap by at least 95%. In other embodiments, the overlapping area of the first area and the second area may be within a range of between 92% and 98%.

Figure 6:
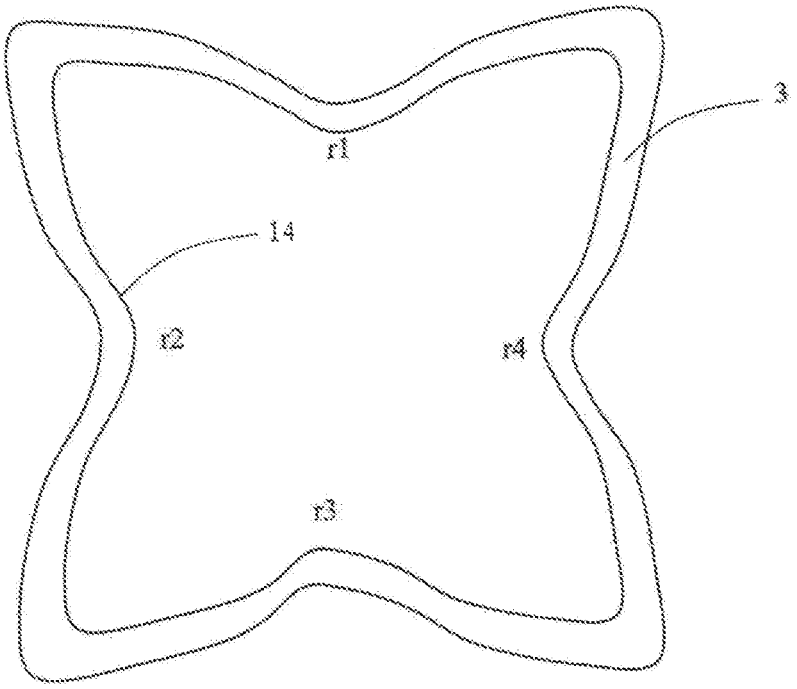
FIG. 6 is a top view of an annular element according to another embodiment of the present invention.

FIG. 6 is a top view of an annular element 3 according to another embodiment of the present invention. Different from the embodiment according to FIG. 3, in the embodiment according to FIG. 6, the annular element 3 may have a substantially constant width, as viewed along the central axis 10. As viewed along the central axis 10, the annular element 3 may have areas r1, r2, r3, r4 that project into the respective gaps.

Figure 7:
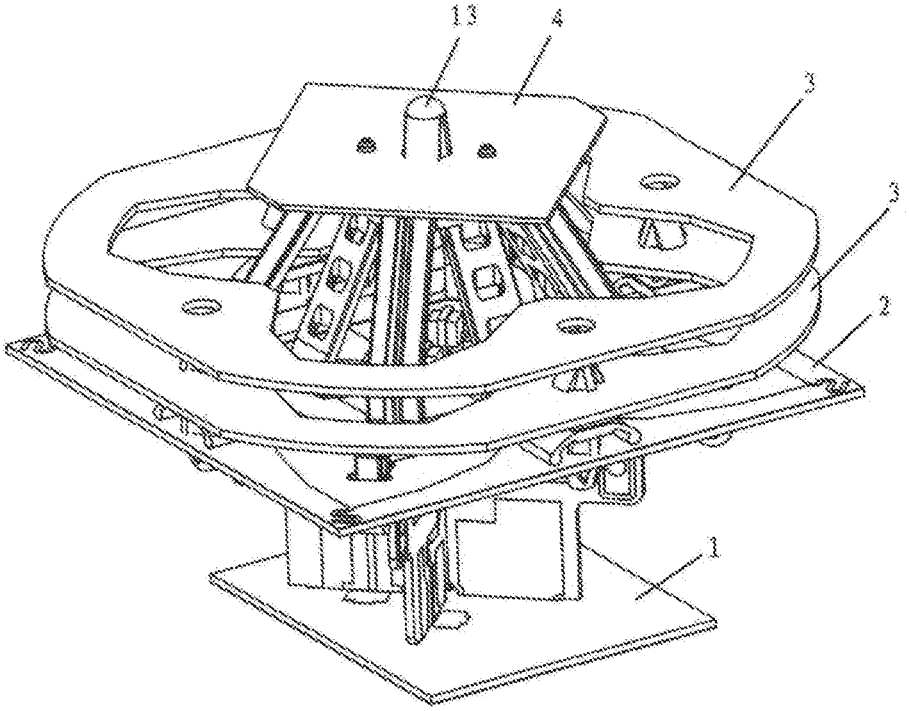
FIG. 7 is a perspective view of a radiator assembly for a base station antenna according to another embodiment of the present invention.

FIG. 7 is a perspective view of a radiator assembly for a base station antenna according to another embodiment of the present invention. The main difference from the embodiment of FIG. 1 lies in that, the radiator assembly of FIG. 7 includes two annular elements 3 mounted above the print circuit board 2, where at least one of the annular elements 3 may have an inner contour that is complaint to the outer contour line of the combination of all four radiating surfaces 12. In other items, reference to the description of the embodiment of FIG. 1 may be used.

It will be understood that, the terminology used herein is for the purpose of describing particular aspects only and is not intended to be limiting of the disclosure. As used herein, the singular forms "a", "an" and "the" are intended to include the plural forms as well, unless the context clearly indicates otherwise. It will be further understood that the terms "comprise" and "include" (and variants thereof), when used in this specification, specify the presence of stated operations, elements, and/or components, but do not preclude the presence or addition of one or more other operations, elements, components, and/or groups thereof. As used herein, the term "and/or" includes any and all combinations of one or more of the associated listed items. Like reference numbers signify like elements throughout the description of the figures.

The thicknesses of elements in the drawings may be exaggerated for the sake of clarity. Further, it will be understood that when an element is referred to as being "on," "coupled to" or "connected to" another element, the element may be formed directly on, coupled to or connected to the other element, or there may be one or more intervening elements therebetween. In contrast, terms such as "directly on," "directly coupled to" and "directly connected to," when used herein, indicate that no intervening elements are present. Other words used to describe the relationship between elements should be interpreted in a like fashion (i.e., "between" versus "directly between", "attached" versus "directly attached," "adjacent" versus "directly adjacent", etc.).

Terms such as "top," "bottom," "upper," "lower," "above," "below," and the like are used herein to describe the relationship of one element, layer or region to another element, layer or region as illustrated in the figures. It will be understood that these terms are intended to encompass different orientations of the device in addition to the orientation depicted in the figures.

It will be understood that, although the terms "first," "second," etc. may be used herein to describe various elements, these elements should not be limited by these terms. These terms are only used to distinguish one element from another. Thus, a first element could be termed a second element without departing from the teachings of the inventive concept.

It will also be appreciated that all example embodiments disclosed herein can be combined in any way.

Finally, it is to be noted that, the above-described embodiments are merely for understanding the present invention but not constitute a limit on the protection scope of the present invention. For those skilled in the art, modifications may be made on the basis of the above-described embodiments, and these modifications do not depart from the protection scope of the present invention.

That which is claimed is:

1. A radiator assembly for a base station antenna that has a central axis, comprising:

two dipoles arranged in a crossed manner, where each of the dipoles includes two dipole arms, and each of the dipole arms has a radiating surface having an outer contour; and an electrically conductive annular element that is mounted above the radiating surfaces, the annular element is configured to be closed circumferentially and having an inner contour which is compliant to an outer contour line for the combination of all four radiating surfaces, wherein the compliance is defined as:

in a projection along the central axis on a projection plane perpendicular to the central axis, the inner contour of the annular element has a projected inner contour line which surrounds a first area;

the outer contours of the radiating surfaces have respective projected outer contour lines, wherein every two adjacent projected outer contour lines are connected through imaginary connecting lines, where each imaginary connecting line is a chord of a respective imaginary circular arc line, wherein each circular arc line is concentric with the central axis and has a radius that is ½ of a maximum radius of the projected outer contour lines of the radiating surfaces, where the projected outer contour lines and the connecting lines together define a maximum outer contour line that is closed circumferentially and that surrounds a second area;

wherein the first area and the second area overlap by at least 90%.

2. The radiator assembly for a base station antenna according to claim 1, wherein the first area and the second area overlap by at least 95%.

3. The radiator assembly for a base station antenna according to claim 1, wherein the first area and the second area overlap by at least 98%.

4. The radiator assembly for a base station antenna according to claim 1, wherein the radiating surfaces are formed on a common printed circuit board.

5. The radiator assembly for a base station antenna according to claim 4, wherein the printed circuit board is mounted above a reflective plate, and that the radiator assembly comprises a plurality of spacers through which the annular element is mounted above the printed circuit board at a predetermined distance.

6. The radiator assembly for a base station antenna according to claim 1, wherein each radiating surface has an outer contour that deviates from a rectangle.

7. The radiator assembly for a base station antenna according to claim 6, wherein, with reference to the central axis, from a radially interior to a radially exterior, the projected outer contour lines of the radiating surfaces have a width that first increases gradually and then decreases gradually.

8. The radiator assembly for a base station antenna according to claim 1, wherein, as viewed along the central axis, there are gaps between every two adjacent radiating surfaces, wherein the annular element has areas that project into the respective gaps.

9. The radiator assembly for a base station antenna according to claim 8, wherein, as viewed along the central axis, the annular element has a greater width in the areas than in remaining areas.

10. The radiator assembly for a base station antenna according to claim 1, wherein the annular element is made of a sheet metal, or the annular element comprises an electrically conductive layer on a printed circuit board.

11. The radiator assembly for a base station antenna according to claim 1, wherein the radiator assembly has a director which is mounted above the annular element.

12. The radiator assembly for a base station antenna according to claim 11, wherein the radiating surfaces are formed on a common printed circuit board, wherein the director is supported on the printed circuit board by means of a holder which has a plurality of support points distributed around the central axis on the printed circuit board.

13. The radiator assembly for a base station antenna according to claim 11, wherein the director is constructed as a metal plate having a prismatic shape oriented such that the corners of the metal plate are located in areas of gaps between adjacent radiating surfaces, as viewed along the central axis.

14. The radiator assembly for a base station antenna according to claim 13, wherein a pair of the corners of the metal plate are chamfered.

15. A radiator assembly for a base station antenna according to claim 13, wherein, in a projection along the central axis on the projection plane, an outer contour of the director has a projected outer contour line which surrounds a third area, wherein the third area overlaps with a projection of the annular element in areas of the corners, and at least 90% of the third area is within the projected inner contour line of the annular element.

16. A radiator assembly for a base station antenna that has a central axis, comprising:

two dipoles arranged in a crossed manner, where each of the dipoles includes two dipole arms, and each of the dipole arms has a radiating surface having an outer contour; and an electrically conductive annular element that is mounted above the radiating surfaces; and a director that is mounted above the annular element wherein the director overlaps the annular element so that an axis that is parallel to the central axis intersects both the director and the annular element.

17. The radiator assembly for a base station antenna according to claim 16, wherein the annular element is closed circumferentially.

18. The radiator assembly for a base station antenna according to claim 16, wherein an inner contour of the annular element has a non-uniform radius.

19. The radiator assembly for a base station antenna according to claim 16, wherein an opening in the center of the annular element has a cross-shape.

* * * * *